US007587774B2

(12) United States Patent
Mayes et al.

(10) Patent No.: US 7,587,774 B2
(45) Date of Patent: Sep. 15, 2009

(54) DIAPER CHANGING STATION HAVING A COLLAPSIBLE FRAME

(76) Inventors: Bernice Mayes, 309 Whispering Glenn Ct., W. Columbia, SC (US) 28033; Averin Mayes, 309 Whispering Glenn Ct., W. Columbia, SC (US) 28033; Jordan Mayes, 309 Whispering Glenn Ct., W. Columbia, SC (US) 28033

( * ) Notice: Subject to any disclaimer, the term of this patent is extended or adjusted under 35 U.S.C. 154(b) by 0 days.

(21) Appl. No.: 11/651,168

(22) Filed: Jan. 9, 2007

(65) Prior Publication Data

US 2008/0163430 A1 Jul. 10, 2008

(51) Int. Cl.
*A47C 27/00* (2006.01)

(52) U.S. Cl. ..... 5/655; 5/99.1; 5/113

(58) Field of Classification Search ..... 5/655, 5/99.1, 8.3, 113–114; 135/90, 96; 119/168, 119/474, 497–498
See application file for complete search history.

(56) References Cited

U.S. PATENT DOCUMENTS

| | | | | |
|---|---|---|---|---|
| 2,253,024 | A | 8/1941 | Farrand | |
| 2,516,869 | A * | 8/1950 | Harris | 135/126 |
| D207,302 | S | 4/1967 | Lemer | |
| 3,656,193 | A | 4/1972 | Alterberg et al. | |
| 4,651,367 | A * | 3/1987 | Osher et al. | 5/99.1 |
| 4,763,606 | A * | 8/1988 | Ondrasik, II | 119/474 |
| 4,781,277 | A | 11/1988 | Lim | |
| 4,999,863 | A | 3/1991 | Kane | |
| 5,335,618 | A * | 8/1994 | Zarola | 119/498 |
| D366,368 | S | 1/1996 | McCarthy | |
| 5,926,881 | A | 7/1999 | Madison | |
| 6,082,305 | A * | 7/2000 | Burns et al. | 119/497 |
| D467,117 | S | 12/2002 | Guy | |
| 7,237,749 | B2 * | 7/2007 | Ritts et al. | 244/118.5 |
| 7,322,315 | B2 * | 1/2008 | Brewer et al. | 119/498 |
| 2006/0016013 | A1 | 1/2006 | Lord et al. | |

* cited by examiner

*Primary Examiner*—Fredrick Conley
(74) *Attorney, Agent, or Firm*—McNair Law Firm, P.A.; Hunter S. Freeman

(57) ABSTRACT

The invention includes a diaper changing station comprising a station housing having an internal collapsible frame and an outer cover. The internal collapsible frame includes: a front frame having a horizontal base, opposing sides extending generally vertical from the base and an arched top interconnecting the opposing sides; a rear frame having a horizontal base, opposing sides extending generally vertical from the base and an arched top interconnecting the opposing sides; opposing collapsible side frames having a plurality of hingedly connected framing rods interconnecting the front and rear frame. The cover includes a flexible fabric enclosing the frame and forms a base, opposing side walls, a rear wall, an open front and a domed hood extending between the arched tops of the front frame and the rear frame and along the entire length of the base; whereby the housing is moveable between an erected position and a collapsed position.

19 Claims, 4 Drawing Sheets

DIAPER CHANGING STATION HAVING A COLLAPSIBLE FRAME

BACKGROUND OF THE INVENTION

This invention is directed to a portable diaper changing station having an internal collapsible frame that provides a parent with sufficient privacy to change a baby's diaper when in public, while providing the baby sufficient space and shade to play or sleep without being burnt by the sun.

There are a number of problems associated with diapering infants while traveling. One such problem is the need to have a device that allows the parent to change the baby's diaper while concealing the child from public view. Furthermore, when traveling with an infant, there are many items that need to be carried such as toys, diapers, lotions, wipes, and other cleaning supplies. There is also a need for a clean, comfortable place to put the baby so that the baby can sleep or have its diaper changed.

Accordingly, an object of the present invention is to provide an enclosure that allows a parent to conceal the baby from public view when changing the baby's diaper and to store various items that may be advantageous to care for the baby.

Another object of the present invention is to provide a housing that protects the baby from harmful UV rays while the baby is playing or sleeping.

Still another object of the present invention is to provide a portable structure that is durable while at the same time lightweight and collapsible for easy transportation.

SUMMARY OF THE INVENTION

The invention is directed towards a diaper changing station comprising a station housing having an internal collapsible frame and an outer cover. The internal collapsible frame includes: a front frame having a horizontal base, opposing sides extending generally vertical from the base and an arched top interconnecting the opposing sides; a rear frame having a horizontal base, opposing sides extending generally vertical from the base and an arched top interconnecting the opposing sides; and opposing collapsible side frames having a plurality of hingedly connected framing rods and interconnecting the front frame and the rear frame.

The cover includes a flexible fabric enclosing the frame and forms a base, opposing side walls, a rear wall, an open front and a domed hood extending between the arched tops of the front frame and the rear frame and along the entire length of the base; whereby the housing is moveable between an erected position for use as a diaper changing station for an infant and a collapsed position for allowing easy transport and storage.

The diaper changing station further includes flexible fabric having a UV ray protecting fabric and liquid and fire resistant fabric.

Each of the opposing, collapsible side frames includes an upper rail and a lower rail, wherein each of the upper rail and the lower rail includes at least 2 of the hingedly connected framing rods that are hingedly connected to the front frame and said rear frame.

The diaper changing station further includes a safety clip interconnecting said framing rods and having a locked condition for maintaining the erected position of the internal collapsible frame and the unlocked condition for allowing movement of the housing between the erected position and the collapsed position.

The diaper changing station further includes a threshold base extension for extending the base outwardly from the open front.

The diaper changing station also includes a vent disposed on one of the opposing side walls and the rear wall. An adjustably secured vent cover for partially or completely obstructing the vent is disposed on an exterior surface of one of the opposing side walls and the rear wall.

The diaper changing station includes a fastener disposed on an exterior surface of the housing for securing the front frame to the rear frame when the housing is in the collapsed position.

The diaper changing station includes a pocket disposed on one of the opposing side walls and the rear wall for allowing objects to be stored in the station housing.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be more fully described.

Figure 1:
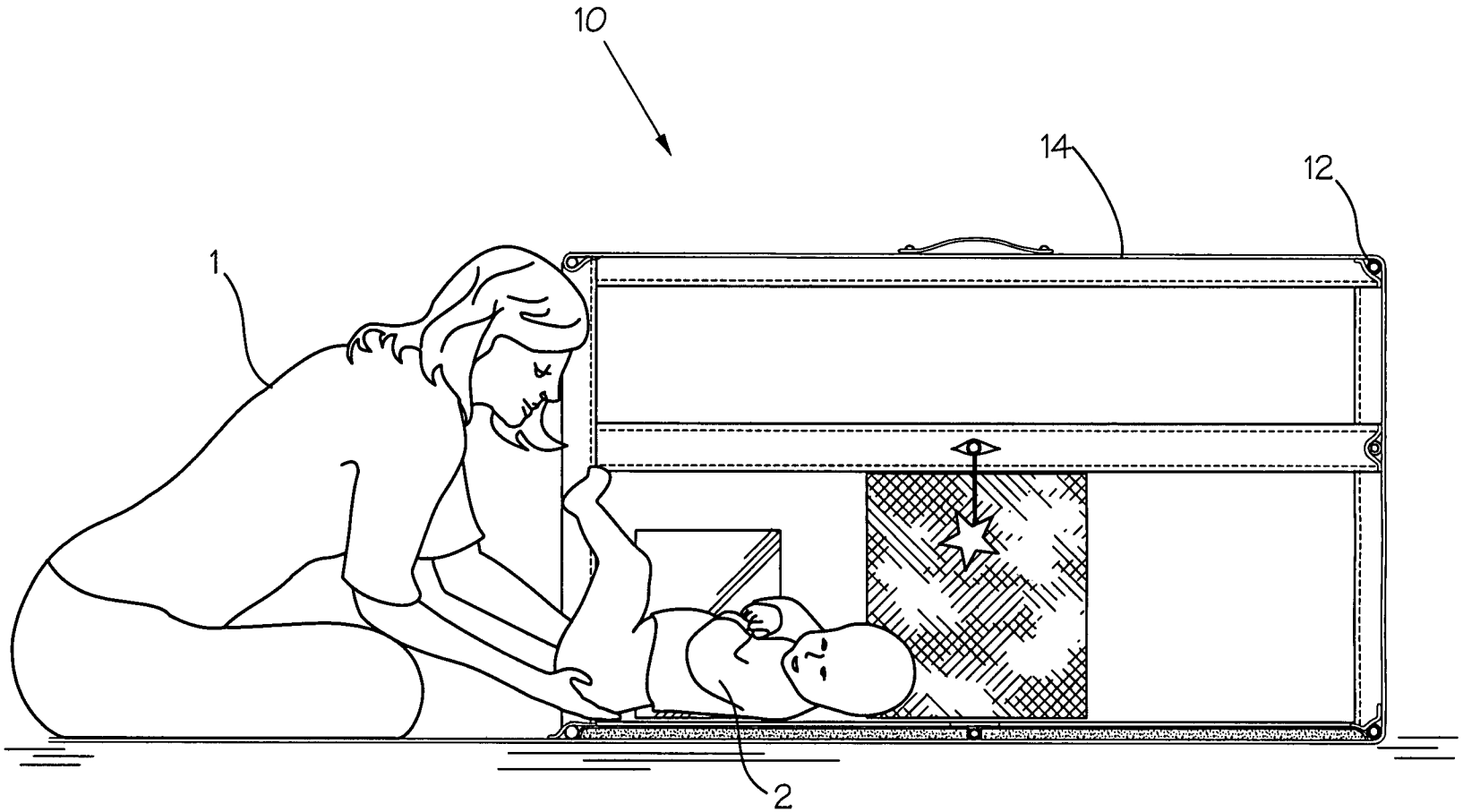
FIG. 1 is a side elevation view illustrating a cutaway of the invention during use.

Referring now to FIG. 1, the diaper changing station is shown generally as 10. A cutaway of the invention during use is shown. The diaper changing station provides a collapsible enclosure (more clearly shown in FIG. 2) that allows a caregiver 1, to change the diaper of an infant 2, while having some privacy to do so. The invention includes an internal collapsible frame 12 that is enclosed in a flexible fabric cover 14. In one embodiment, the flexible fabric is sewn around internal collapsible frame as shown. In alternate embodiments, the cover can enclose internal frame 12 by any fastener such as snaps, zippers or Velcro®.

Figure 2:
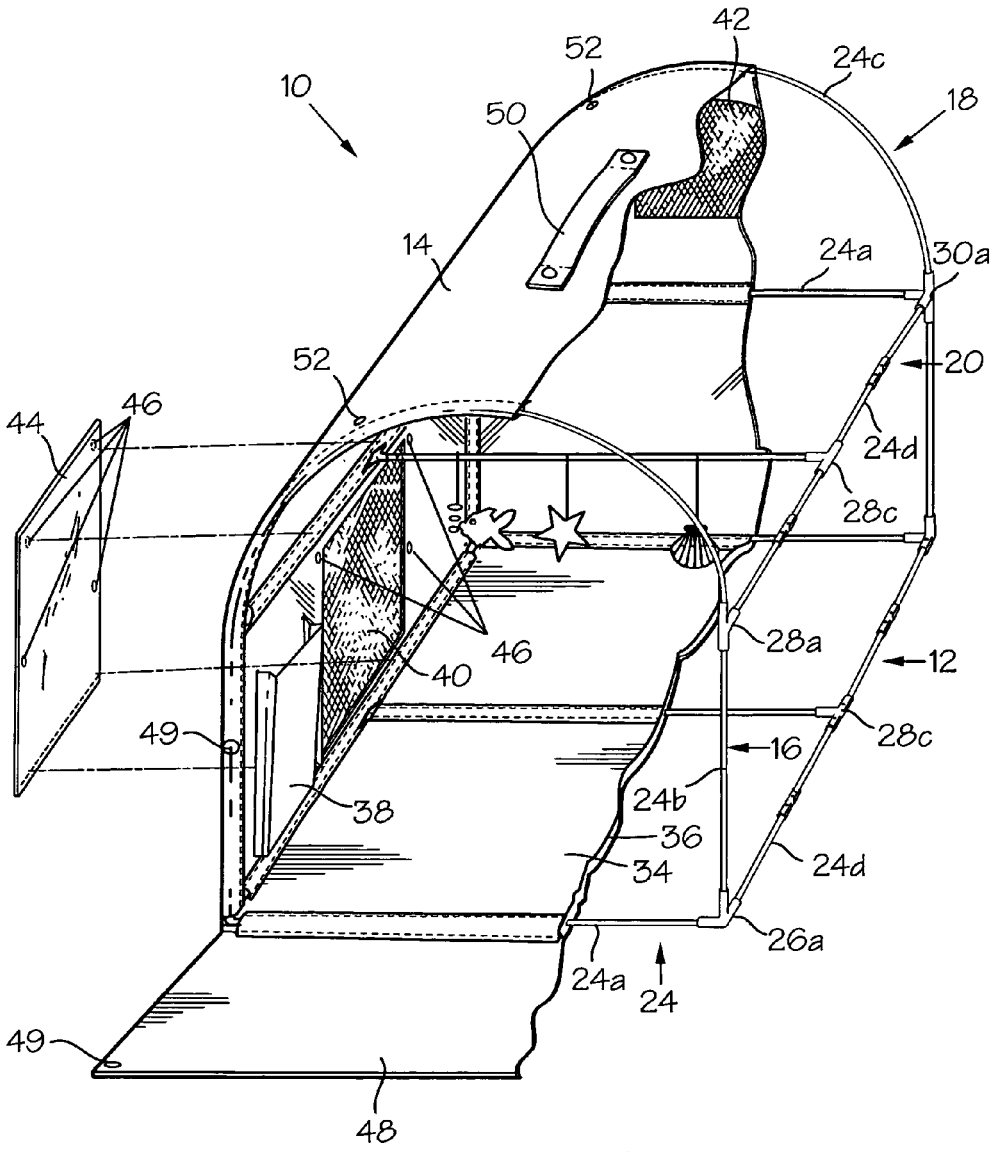
FIG. 2 is perspective view illustrating a cutaway of the invention.
Figure 3:
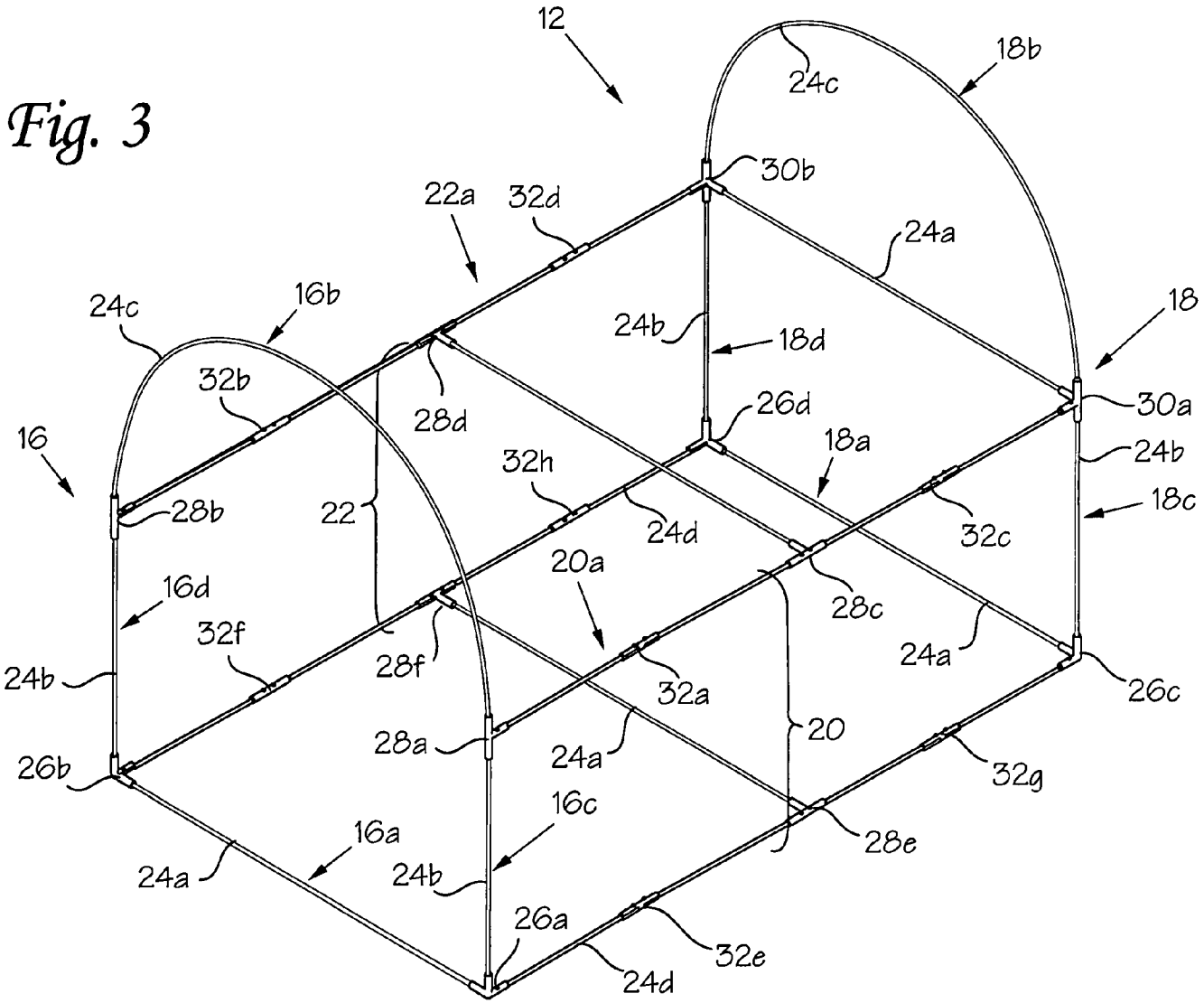
FIG. 3 is a perspective view illustrating the internal frame of the invention.
Figure 4:
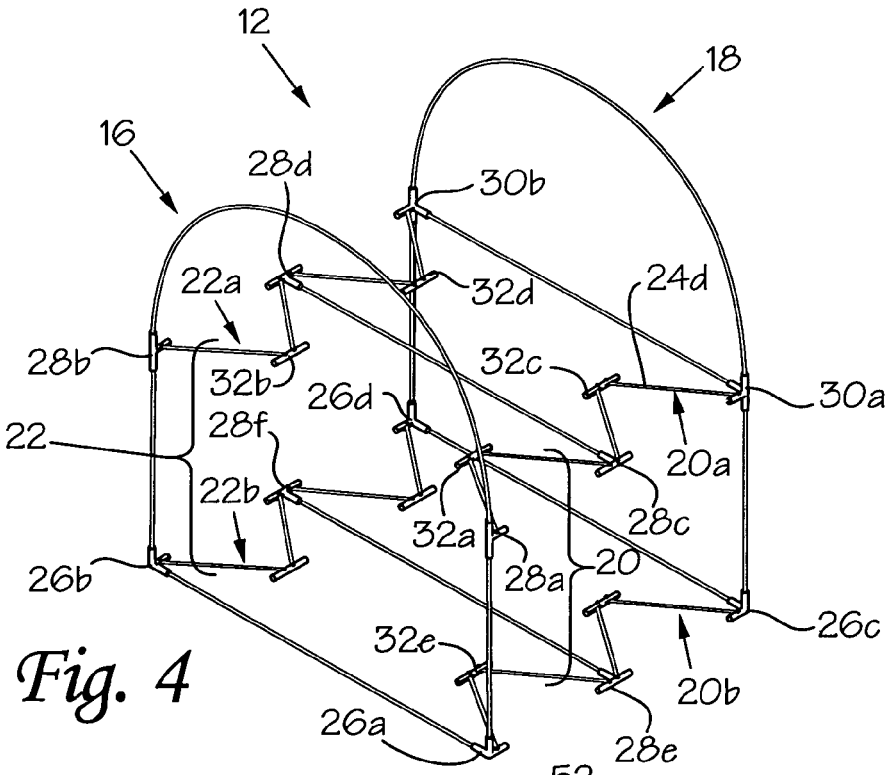
FIG. 4 is a perspective view illustrating the internal frame of the invention in a collapsed position; and, FIG. 5 is a perspective view illustrating the invention in a collapsed position.

Referring now to FIGS. 2-4, frame 12 includes a front frame generally shown as 16, a rear frame generally shown as 18 and two collapsible side frames generally shown as 20 and 22 interconnecting the front frame and the rear frame. Frame 12 is formed of a plurality of flexible frame rods, generally shown as 24, interconnected by hinged clips. In one embodiment, the frame 12 is formed of four different sized rods shown as 24*a*, 24*b*, 24*c* and 24*d*. In at least one embodiment, flexible rods 24 are made of fiberglass and the hinged clips are friction clips that hold flexible rods in position by a friction grip. The friction grip clips act as a safety clips for preventing the internal, collapsible frame 12 from unintentional collapse without human interaction. In at least one alternate embodiment, one or more of the hinged clips could include an additional safety mechanism such as a detent lock for providing a locked position such as when the frame is in an erect position so as to prevent the hinges in the hinged clips from operating and thus preventing the framing rods from pivoting about the hinge when the safety clip is in a locked condition. To allow the hinged nature of the hinged clips to be used, the safety clips must be placed in an unlocked condition such as by pressing a button on the clip thus allowing the rods to pivot about the hinge.

Front frame 16 has a generally arched shaped consisting of a base 16*a* and a domed top 16*b* interconnected by two sides 16*c* and 16*d*. To provide a point of reference, the X axis will be defined as extending along the width of the frame, the Y axis as extending from the base to the domed portion and the Z axis extending from the front frame to the rear frame. The base 16*a* includes a framing rod 24*a* that interconnects two three-way clips 26*a* and 26*b* that allow flexible framing rods 24*a*, 24*b* and 24*d* to extend from the three-way clip along the X, Y, and Z axis, where the framing rod 24*d* extending along the Z axis is hingedly connected to the three-way clip. Framing rod 24*a* extends along the X axis to interconnect three-way clips 26*a* and 26*b*. The side of front frame 16 are formed by two opposing framing rods 24*b* that extend along the Y axis connecting each of the three way clips 26*a* and 26*b* to a three-way "T" clip 28*a* and 28*b* that allow framing rods 24*b*, 24*c* and 24*d* to extend along the Y and Z axis, where the framing rod 24*d* extending along the Z axis is hingedly connected to the three-way clip. The domed top 16*b* is formed by a fourth framing rod 24*c* that interconnects the three-way "T" clips 28*a* and 28*b* by extending between the "T" clips in an arched fashion, thus creating a domed top.

Much like the front frame, the base 18*a* of rear frame 18 is formed by framing rod 24*a* which interconnects two three-way clips 26*c* and 26*d* that are substantially identical to the clips represented by 26*a* and 26*b*. The sides 18*c* and 18*d* are formed by framing rods 24*b* that extend along the Y axis from each of the three-way clips 26*c* and 26*d*, interconnecting each of the three-way clips with a four-way clip 30*a* and 30*b* that allows framing rods 24*a*, 24*b*, 24*c* and 24*d* to extend from the clip along the X, Y and Z axis, where the framing rod 24*d* extending along the Z axis is hingedly connected to the four-way clip. Much like front frame 16, the domed top 18*b* of rear frame 18 is formed by a framing rod 24*c* which interconnects four-way clips 30*a* and 30*b* and extends between them in an arched fashion. Four-way clips 30*a* and 30*b* are also interconnected by a fifth framing rod 24*a* which extends between the four-way clips in parallel relation to the framing rod 24*a* that forms the base 18*a* of the rear frame 18.

While front frame 16 and rear frame 18 have been described as being formed by several framing rods 24*a*, 24*b* and 24*c*, both the front and rear frame could be formed by one pre-formed framing rod. In such an embodiment, the need for the three-way clips 26*a*, 26*b*, 26*c*, 26*d*, 28*a*, 28*b*, and four-way clips 30*a* and 30*b* would be alleviated and such clips could be replaced with a clip that allows the framing rods 24*d* that form a portion of the side frames 20 and 22 to be hingedly connected to the front and rear frames so that when in an erect position, the side frames interconnect front frame 16 and rear frame 18 by extending along the Z axis. When in a collapsed position, however, the hinged connection would allow the framing rods to extend along or generally parallel to the X axis.

Referring now to FIGS. 3 and 4, collapsible side frames 20 and 22 can be more clearly seen. The side frames interconnect front frame 16 and rear frame 18 and are collapsible. Side frames 20 and 22 include opposing upper rails 20*a* and 22*a* and opposing lower rails 20*b* and 22*b*. In at least one embodiment, each upper rail is formed by four framing rods 24*d* interconnected by hinged clips 32*a*, 32*b*, 32*c*, 32*d*, 28*c* and 28*d*. Upper rails 20*a* and 22*a* are hingedly connected to front frame 16 via three way "T" clips 28*a* and 28*b*, each of which includes one hinge along the Z axis. On each upper rail 22*a* and 20*a*, framing rod 24*d* extends from the "T" clip, and connects each "T" clip 28*a* and 28*b* to a set of two-way linear dual-hinged clips 32*a* and 32*d*. The dual-hinged nature of the two-way linear clip allows both framing rods that are hingedly interconnected by the clip to pivot between the X axis and the Z axis. Two-way clips 32*a* and 32*b* are connected to a set of three-way dual-hinged "T" clips 28*c* and 28*d* by a framing rod 24*d*. These dual-hinged "T" clips allow the framing rods 24*d* that form the upper rails 20*a* and 22*a* of the collapsible side frames to pivot between the X axis and the Z axis. The "T" clips 28*c* and 28*d* are interconnected by another framing rod 24*d* to another set of two-way linear dual-hinged clips 32*c* and 32*d*, which in turn are interconnected to the rear frame by a set of framing rods 24*d* that are hingedly connected to the rear frame via the four-way clips 30*a* and 30*b*.

Much like upper rails 20*a* and 22*a*, lower rails 20*b* and 22*b* interconnect front frame 16 and rear frame 18 and in at least one embodiment, are formed by four framing rods 24*d* interconnected by hinged clips 32*e*, 32*f*, 32*g*, 32*h*, 28*e* and 28*f*. Much like upper rails 20*a* and 22*a*, lower rails 20*b* and 22*b* are formed by a first set of framing rods 24*d* which interconnect the hinged "T" clips 26*a* and 26*b* of the front frame 16 to a set of two-way dual-hinged clips 32*e* and 32*f*, which are connected to a set of dual-hinged "T" clips 28*e* and 28*f* by a second set of framing rods 24*d*. The "T" clips are interconnected, by a set of framing rods, with a second set of two-way dual-hinged clips 32*c* and 32*d*, which are connected to the hinged three-way clips 26*c* and 26*d* of the rear frame via a set of framing rods 24*d* that are hingedly connected to the three-way clips 26*c* and 26*d*.

In at least one embodiment, the opposing upper rails 20*a* and 22*a* are interconnected by a framing rod 24*a* that extends in a generally perpendicular relation to the upper rails 20*a* and 22*a* to provide increased structural integrity. Similarly, the opposing lower rails 20*b* and 22*b* are interconnected by a framing rod 24*a* that extends in a generally perpendicular relation to the lower rails. The framing rod connecting the opposing lower rails is covered by the flexible fabric cover 14 and padding 15 contained within the flexible fabric cover so that the framing rod is out of sight and out of the way. While the friction fitting of the clips and the locking safety mechanism alleviate the need for increased structural integrity, the framing rod connecting the upper rails 20*a* and 22*a* extends through the interior of the diaper changing station providing extra stability as well as a means for hanging objects such as a mobile, towel, diaper, or any other object that may be hung over framing rod.

In alternate embodiments, however, the framing rod interconnecting collapsible side frames are not included. In such embodiments, the friction fit safety clips and/or the locking safety clips allowing the hinged nature of the "T" clips 28*c*, 28*d*, 28*e*, and 28*f* to be utilized only after the safety clip is placed in an unlocked condition alleviate the need for the framing rod interconnecting the opposing upper rails 20*a* and 22*a*. When in an erect position, safety clips 28*c* and 28*d* are placed in a locked condition so that the framing rods interconnected by the safety clips may not pivot about the hinge of the "T" clips 28*c* and 28*d* until the safety clips are placed in an unlocked condition, thus allowing the framing rods to pivot about the hinge and the frame to collapse.

While the collapsible side frames 20 and 22 have been generally described as having opposing upper rails 20*a* and 22*a* and opposing lower rails 20*b* and 22*b*, in alternate embodiments, collapsible side frames are formed by a single set of opposing side rails. In another embodiment, collapsible side rails 20 and 22 could be formed by opposing upper rails 20*a* and 22*a* and opposing lower rails 20*b* and 22*b* that consist of two framing rods interconnected by dual-hinged "T" clips 28*c* and 28*d*, thus alleviating the need for the additional dual-hinged clips 32*a*, 32*b*, 32*c*, and 32*d*. In another embodiment, more than four framing rods could be interconnected by the hinged clips, depending on the desired length of the framing rods or the internal frame itself.

Referring now to FIG. 2, the internal, collapsible frame 12 is enclosed in a flexible fabric cover 14. In one embodiment, the fabric cover provides a barrier to UV rays to prevent the infant from becoming burnt and is resistant to liquids. The fabric cover is also fire resistant. One such fabric cover is polyester. The base 34 of the diaper changing station includes padding 36 enclosed by flexible fabric cover 14 for providing support and comfort to the infant using the invention.

The diaper changing station includes at least one pocket 38 for storing objects such as diapers, cloths, pacifiers or any other desired object. In one embodiment, two pockets are disposed on an interior surface of the side walls of the invention. However, in alternate embodiments any number of pockets could be included which could be disposed on an interior or exterior surface of either side walls or rear wall of the diaper changing station.

The diaper changing station further includes a plurality of vents 40 and 42, for allowing fresh air to circulate throughout the changing station. In at least one embodiment, the vents are made of a mesh fabric allowing air to circulate while keeping bugs or debris from entering the diaper changing station. In alternate embodiments, the vents could be formed by an opening in the fabric 14. Each vent includes an adjustable cover 44 for allowing the vent to be partially or completely obstructed. In one embodiment, the adjustable cover comprises a piece of flexible fabric that is attached to the bottom of the vent and includes several fasteners that allow the cover to be fastened at various vertical points along the height of the vent for partially or completely obstructing the vent. While the shown embodiment includes two vents, alternate embodiments allow for any number of vents desired. In the shown embodiment, the fasteners 46 for securing the cover 44 to the vent 40 are snaps. In alternate embodiments, however, any fastener that would allow the cover to be secured to the vent may be used.

In at least one embodiment, the diaper changing station has a height of twenty-four inches, which is measured from the base to the top of the domed roof; a width of twenty-two inches, which is measured from the left side frame to the right side fame; and a length of twenty-five inches, which is measured from the front frame to the rear frame. To provide an adjustable length, a flexible extension 48 is provided. The extension is disposed at the open front and has a width substantially identical to the width of the diaper changing station and extends outwardly eight inches. In one embodiment, the extension folds under or over the base 34 or may be secured via fasteners 49 to the fabric cover 14 supported by front frame 16 to create a small gate-like barrier to the open front. In at least one embodiment, the extension has a shape that is generally consistent with or similar to that of the front frame. In such an embodiment, when in a closed position, so that fasteners 49 secure extension 48 to front frame 16, a closure is provided for completely obstructing the open front created by flexible fabric cover 14 and internal frame 12.

In one embodiment, the diaper changing station is provided with a handle 50 for allowing easy movement or transportation of the invention. While the shown embodiment illustrates the handle 50 being disposed on the domed top of the diaper changing station, the handle could be disposed on any exterior surface of the invention. Further, the handle could be adjustably securable having one end disposed on the arched top of either the front frame 16 or the rear frame 18 and another end that is attachable to the arched top of the opposing frame so that when in a collapsed position, the handle may be secured in such a fashion so that front frame and rear frame are secured to one another. In one embodiment, the outer cover includes fasteners 52 disposed adjacent the front and rear frames for securing the front frame 16 to the rear frame 18 when in a collapsed position. Thus, the front and rear frame can be used as a handle to aid in transport of the diaper changing station when in a collapsed position.

Figure 5:
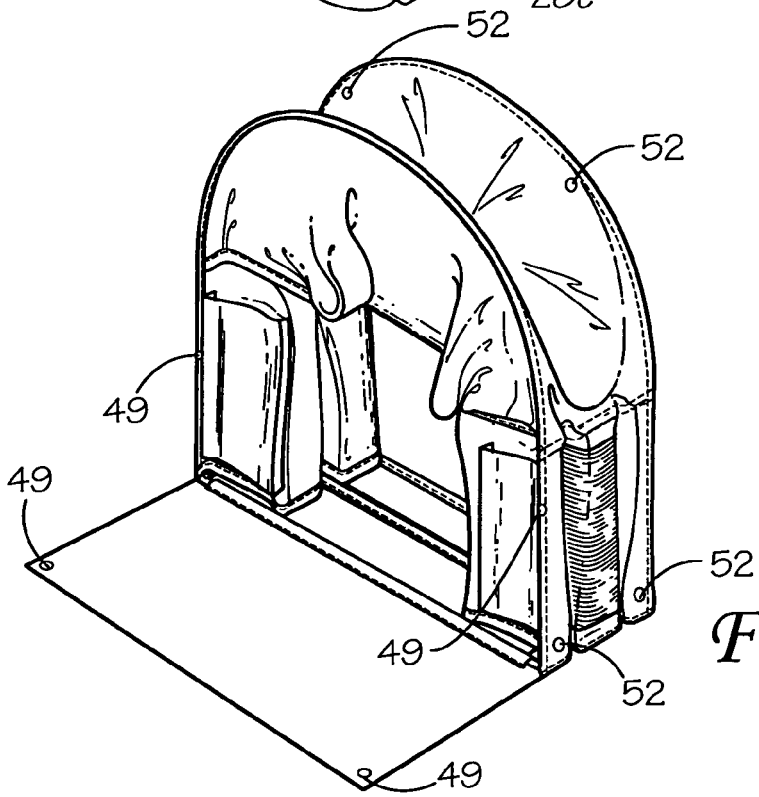

Referring now to FIG. 5, the collapsible nature of the diaper changing station can be more clearly seen. For easy transport, diaper changing station may be collapsed whereby the domed top, sides and base all fold inwardly so that the entire collapsed station has a shape generally matching that of the front and rear frames 16 and 18. Fasteners 52 allow front and rear frame to be secured along the domed top and sides of front and rear frame so that the changing station remains secured in a collapsed position during transport. Extension 48 may be secured to front frame 16 via the use of fasteners 49 so that the extension does not become snagged or torn during transport.

While a preferred embodiment of the invention has been described using specific terms, such description is for illustrative purposes only, and it is to be understood that changes and variations may be made without departing from the spirit or scope of the following claims.

What is claimed is:

1. A diaper changing station comprising:

a station housing having an internal collapsible frame and an outer cover;

said internal collapsible frame including;

a front frame having a plurality of framing rods forming a horizontal base, opposing sides extending generally vertical from said base and an arched top interconnecting said opposing sides;

a rear frame having a plurality of framing rods forming a horizontal base, opposing sides extending generally vertical from said base and an arched top;

a first collapsible side frame and a second collapsible side frame opposing said first collapsible side frame, each of said collapsible side frames having a plurality of hingedly connected framing rods interconnecting said front frame and said rear frame, wherein each of said framing rods includes a first hinge disposed generally at a first distal end and on a first side of said framing rods and a second hinge disposed generally at a second end opposite said first distal end on a second side opposite said first side so that each of said first and second distal ends hingedly cooperate with a distal end of adjacent framing rods and said collapsible side frames collapses along a single horizontal axis;

said cover including a flexible fabric enclosing said frame and forming a base, opposing side walls, a rear wall, an open front and a domed hood extending between said arched tops of said front frame and said rear frame and along the entire length of said base;

whereby said housing is moveable between an erected position for use as a diaper changing station for an infant and said collapsed position for allowing easy transport and storage.

2. The station of claim 1, wherein said flexible fabric includes UV ray protecting fabric.

3. The station of claim 1, wherein said flexible fabric includes liquid and fire resistant fabric.

4. The station of claim 1, wherein each of said opposing, collapsible side frames includes an upper rail and a lower rail, wherein each of said upper rail and said lower rail includes at least 2 of said hingedly connected framing rods that are hingedly connected to said front frame end said rear frame.

5. The station of claim 1, wherein said first and second hinge comprise a safety clip pivotally interconnecting said framing rods and having a locked condition for maintaining said erected position of said housing by preventing said framing rods from pivoting in relation to said safety clip and an unlocked condition for allowing movement of said framing rods and thus allowing movement of said housing between said erected position and said collapsed position.

6. The station of claim 1, including a threshold base extension for extending said base outwardly from said open front.

7. The station of claim 1, including a vent disposed on one of said opposing side walls and said rear wall.

8. The station of claim 7, including an adjustably secured vent cover for partially or completely obstructing said vent.

9. The station of claim 8, wherein said cover is disposed on an exterior surface of one of said opposing side walls and said rear wall.

10. The station of claim 1, including a fastener disposed on an exterior surface of said housing for securing said front frame to said rear frame when said housing is in said collapsed position.

11. The station of claim 1, including a pocket disposed on one of said opposing side walls and said rear wall for allowing objects to be stored in said station housing.

12. A diaper changing station comprising:

an internal collapsible frame collapsible along a single axis;

an outer flexible cover enclosing said frame and forming a base, opposing side walls, a rear wall, an open front and a top extending along a length of said base;

a collapsible housing formed by said inner collapsible frame and said outer cover, said collapsible housing having an erected position for accommodating an infant in the housing as a diaper changing station and a collapsed position for portability and storage of articles in the housing when in said collapsed position;

said internal collapsible frame including a front frame and a rear frame, each having a horizontal base, opposing sides extending generally vertical from said base and an arched top interconnecting said opposing sides, said internal collapsible frame further including a first collapsible side frame and a second collapsible side frame opposing said first collapsible side frame, each of said collapsible side frames having a plurality of hingedly connected framing rods interconnecting said front frame and said rear frame, wherein a first framing rod is hingedly connected to one of said front frame and said rear frame and is capable of pivoting in a clockwise direction and a second framing rod is hingedly connected to said first framing rod and is capable of pivoting in a counterclockwise direction so that said framing rods are placed in a generally perpendicular position relative to said single axis when said collapsible housing is placed in said collapsed position.

13. The station of claim 12 including a closure for closing said open front when said housing is in said erected position and for retaining articles when said housing is in said collapsed position.

14. The station of claim 12 wherein said framing rods are placed in a generally perpendicular position relative to said single axis with a distal end of each of said framing rods of said first collapsible side frame being laterally spaced within a single plane from an opposing distal end of said framing rods in said second collapsible side frame when said first and second collapsible side frames are placed in a collapsed position.

15. The station of claim 12, wherein each of said opposing collapsible side frames includes an upper rail and a lower rail, wherein each of said upper rail and said lower rail includes at least four of said hingedly connected framing rods that are hingedly connected to said front frame and said rear frame.

16. The station of claim 12, wherein said internal, collapsible frame includes a safety clip interconnecting said framing rods and having a locked condition for maintaining said erected position of said collapsible housing and an unlocked condition for allowing movement of said collapsible housing between said erected position and said collapsed position.

17. The station of claim 12, including a fastener disposed on an exterior surface of said housing for securing said front frame to said rear frame when said diaper changing station is in said collapsed position.

18. The station of claim 12, including a threshold base extension for extending said base outwardly from said open front.

19. The station of claim 18, wherein said threshold base extension has an open position for creating a barrier to said open front and a closed position for creating a barrier to said open front.

* * * * *